United States Patent [19]

Fleming et al.

[11] Patent Number: 4,904,987

[45] Date of Patent: Feb. 27, 1990

[54] AIR SAMPLING AND ALARM CONTROL SYSTEM

[76] Inventors: William T. Fleming, 139 Red Mill Rd., Glen Gardner, N.J. 08826; Hill S. Lalin, 10 Bonita Ter., Wayne, N.J. 07470

[21] Appl. No.: 133,615

[22] Filed: Dec. 16, 1987

[51] Int. Cl.[4] ..... G08B 21/00

[52] U.S. Cl. ..... 340/611; 340/626

[58] Field of Search ..... 340/626, 611, 607, 608, 340/606; 200/81 R, 83 R, 83 A; 73/707, 38

[56] References Cited

U.S. PATENT DOCUMENTS

| | | | |
|---|---|---|---|
| 1,714,373 | 6/1928 | Johnson | 73/707 X |
| 1,818,258 | 6/1928 | Isaacks | 73/707 X |
| 1,957,894 | 5/1934 | Longnecker | 73/707 X |
| 2,843,077 | 7/1958 | Leefer | 73/38 |
| 3,304,546 | 2/1967 | Kern et al. | 340/611 |
| 4,336,533 | 6/1982 | Wettach | 340/626 |
| 4,532,814 | 8/1985 | Lalin | 73/863.03 |
| 4,635,047 | 1/1987 | Fox et al. | 340/611 |

*Primary Examiner*—Joseph A. Orsino
*Assistant Examiner*—Jeffery A. Hofsass

[57] ABSTRACT

An air sampling and alarm control system for detecting the presence of a toxic contaminant in the atmosphere and for providing an audible alarm when insufficient gas flow is present in the system to adequately test for the presence of the contaminant. The alarm control is provided by a pressure switch which is electrically connected in circuit with an audible alarm and pneumatically connected in circuit with the gas flow line connecting the sampling pump to the sampling detector.

6 Claims, 2 Drawing Sheets

AIR SAMPLING AND ALARM CONTROL SYSTEM

FIELD OF THE INVENTION

This invention relates to an air sampling and an alarm control system for sampling air to determine if a contaminant is present in the atmosphere and more particularly to an air sampling alarm control which includes means responsive to the absence of a predetermined level of air flow through in the system for sounding an audible alarm.

BACKGROUND OF THE INVENTION

In the field of environmental hygiene, air sampling is regularly performed to analyze for the presence of certain impurities within the atmosphere. The sampling method may involve drawing a known volume of air through a collecting device to form a test sample. The test sample is thereafter analyzed by any known method of analysis, such as chromatography or atomic adsorption to determine the the impurity and its concentration in the sample.

In many instances, it is necessary only to sample the atmosphere in a defined area to test for the presence of a toxic contaminate above a predetermined minimum level to determine if the atmosphere is life-threatening. In these situations, an electrochemical cell sensitive to the presence of the specific noxious chemical is used as an air sampling detector. To operate the cell properly, a sample volume of air at a predetermined flow rate is passed through the electrochemical cell. As long as a sufficient quantity of air passes through the reagent in the cell, the cell will reliably respond to the presence of the contaminate by changing color. A restriction in air flow or total blockage of air to the cell may give the user a false indication of an acceptable atmosphere. This is particularly dangerous where the air sample is deliberately being taken from a remote location to test the atmosphere in the remote location. The open end of the tubing from which air is to be drawn can readily be blocked or submerged under water or the tubing may kink in taking the test, thereby restricting air flow which prevents proper testing.

SUMMARY OF THE INVENTION

Therefore, the purpose of the present invention is to provide a novel and inexpensive air sampling and alarm control system which will produce an audible alarm in response to a failure or substantial reduction in air flow, thereby spontaneously indicating that the sampling system has become inoperative. The air sampling and alarm control system of the present invention comprises a vacuum pump driven by a motor, a sampling cell connected to one end of said pump for sampling the atmosphere in a given area, a pressure switch connected to one end of said pump for sensing the pressure at a designated location in the system, means connected between said pressure switch and said pump for dampening pulsations in flow to said pressure switch, a valve for controlling the set point at which said pressure switch is activated, and audible alarm means responsive to said pressure switch for sounding an audible alarm when the pressure at said designated location drops to below a predetermined level.

OBJECTS AND BRIEF DESCRIPTION OF DRAWING

The principal object of the present invention is to provide an air sampling and alarm control system which will produce an audible sound when the system becomes inoperable due to a restriction or blockage of air flow.

Other objects and advantages of the invention will become apparent from the following detailed description when read in conjunction with the accompanying drawings in which.

DETAILED DESCRIPTION OF INVENTION

Figure 1:
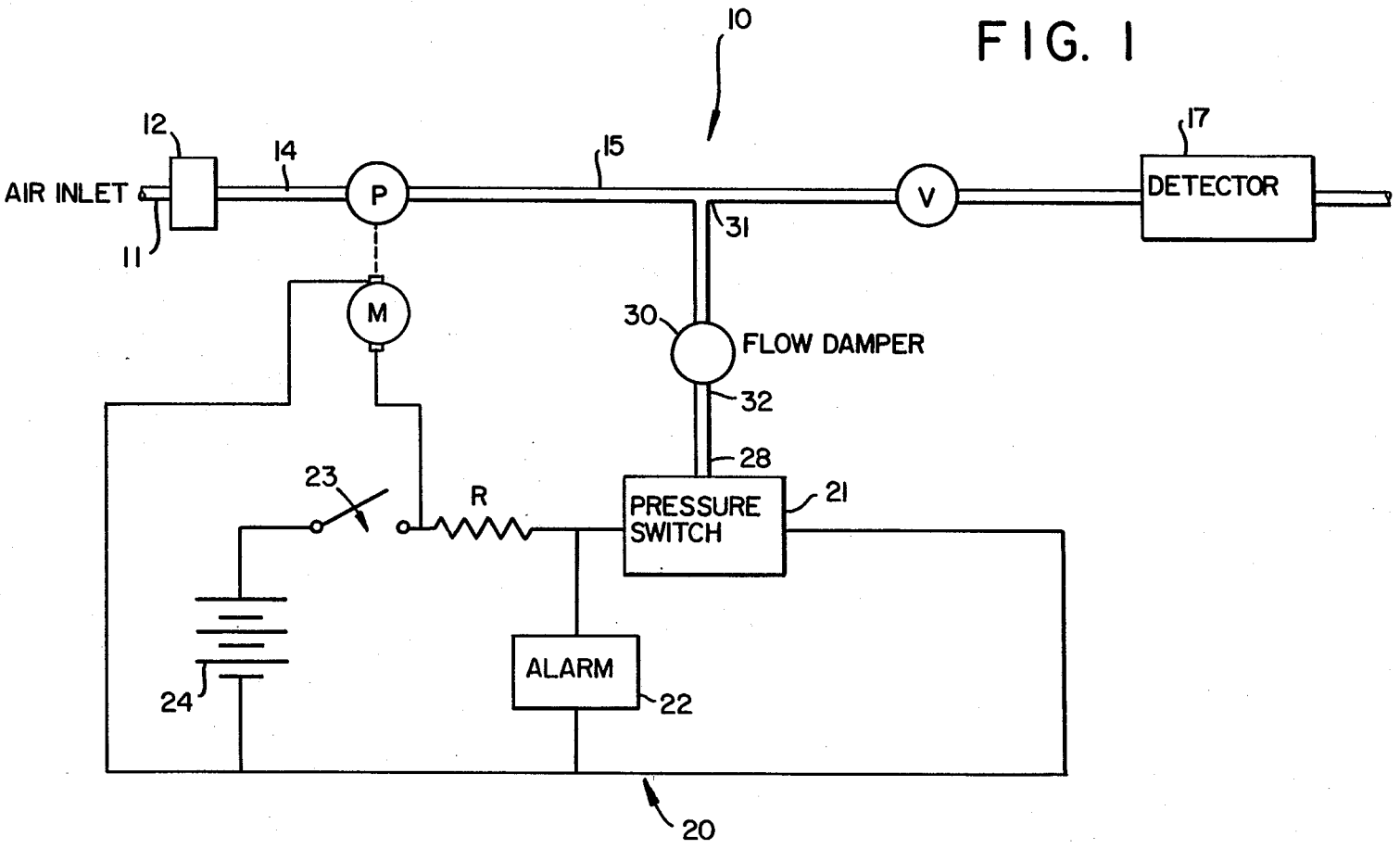
FIG. 1 is a schematic block diagram of the present invention.

The system (10) of the invention is illustrated in the attached drawing comprising an input air inlet (11), an air filter (12), gas tubing (14), a vacuum pump (P), and a sampling detector (17). The air inlet (11) is adapted to permit a gas sample to be drawn by the vacuum pump (P) and presented to the sampling detector (17). The air filter (12) is an optional component connected to the suction side of the pump (P) to filter debris and particulate matter. A motor (M) is connected to a source of power (not shown) for driving the pump (P). The discharge side of the pump (P) is connected through tubing (15) to a valve (V) which, in turn, is connected to the sampling detector (17). The sampling detector (17) may represent any conventional detection device which is designed to respond to a predetermined toxic chemical fed through the detector at a concentration above a predetermined minimum level, by causing a reaction with changes the color of the detector. The valve (V) controls the set point at which the alarm is sounded, i.e., it controls the minimum flow to activate the pressure switch (21). The valve (V) may be manually adjustable.

An alarm control circuit (20) is an integral part of the system (10) and includes a pressure switch (21) connected electrically in circuit with an audible alarm (22) and a source of power (24), such as a battery. The alarm control circuit (20) is also connected pneumatically to the conduit (15) through which the gas sample flows. A resistor (R) may be included in the electrical circuit in series with the alarm (22) to control the current to the alarm (22). The alarm (22) may include a speaker or buzzer to provide an audible sound when insufficient air flow is present in tubing (15). The electrical circuit may also include a manual on/off control switch (23).

Any conventional pressure switch (21) may be used to detect the presence of a predetermined minimum level of air flow in the line (15). The pressure switch (21) is normally closed to short out the alarm (22). The pressure switch has an air chamber (not shown) which closes an internal switch (shown diagrammatically) when the pressure at the inlet (28) to the pressure switch (21) is above a predetermined minimum level corresponding to a minimum air flow level in tubing (15). When the inlet pressure (28) to the pressure switch (21) drops below the predetermined minimum level, the pressure switch opens thereby actuating the alarm (22).

Ordinarily the pressure switch (21) would repeatedly open and close in response to pulsations produced by the pump (P). To overcome this problem, a flow damper (30) is preferably placed between the pressure switch (21) and the connection point (31) with the tubing (15). Any flow damping means may be used to minimize perturbations in air flow to the pressure switch (21). A very inexpensive air flow dampening means may be provided by interposing a fixed air restriction in line (32), such as by means of a small length of stainless steel tubing to provide a predetermined restriction to flow. The pressure switch (21) would then respond to an inlet pressure (28) which will fluctuate only slightly in proportion to the fluctuations in air pressure in the line (15). Such slight fluctuations will not affect the operation of the pressure switch (21). On the other hand, the pressure switch (21) will respond positively when the air flow in line (15) drops below a predetermined minimum level to actuate the alarm (22).

Figure 2:
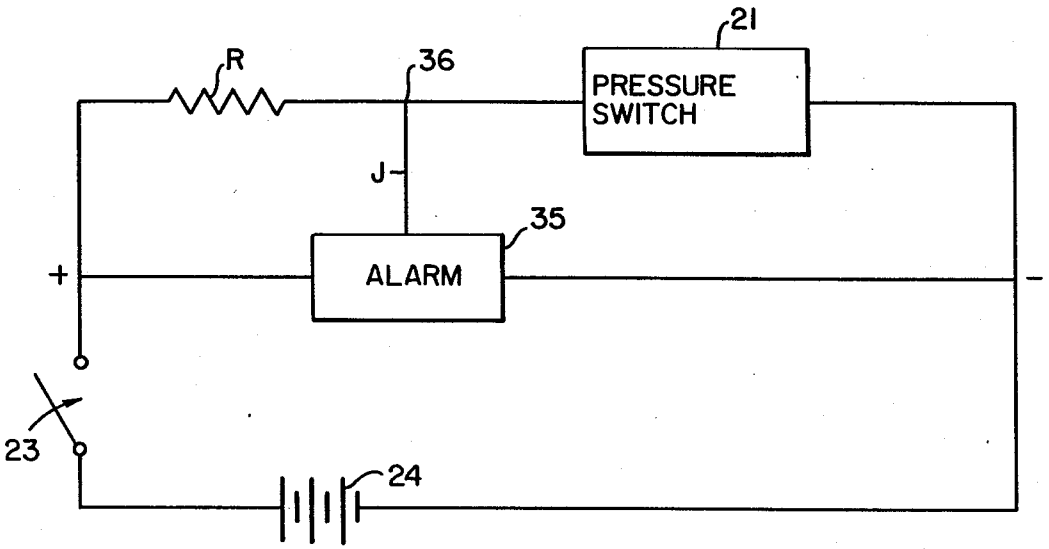
FIG. 2 is an alternate alarm circuit for FIG. 1.

An alternate embodiment for the alarm circuit of FIG. 1 using a three terminal alarm (35) is shown in FIG. 2. The alarm (35) of FIG. 2 is a conventional three terminal, electronic-controlled alarm having a control terminal which senses the voltage level at point 36. Point 36 is used as a control reference for operating the alarm. When the voltage at point 36 is low, representing the closed position of pressure switch (21), the alarm (35) is triggered. Conversely, when the pressure switch (21) is open, point 36 represents a logical high and the alarm (35) is deactivated. FIG. 2 drains less power from the battery (24) and from this point of view is more desirable than the alarm circuit of FIG. 1, even though the alarm is more expensive.

We claim:

1. An air sampling and alarm control system comprising a vacuum pump driven by a motor, with one end of said vacuum pump open to the atmosphere, air sample detection means connected to the opposite end of said vacuum pump for detecting the presence of a predetermined contaminant in a sample of said atmosphere drawn through said vacuum pump, a pressure switch pneumatically connected at one end thereof to a common connection between said vacuum pump and said sample detection means and said pressure switch being pneumatically open to the atmosphere at the opposite end thereof, with said pressure switch being connected electrically in circuit between a source of power and an audible alarm for actuating said alarm in response to a predetermined pressure change at said common connection between said vacuum pump and said sample detection means, and air flow damping means interposed between said pressure switch and said common connection for dampening pulsations in air flow caused by said motor drive.

2. An air sampling and alarm control system as defined in claim 1 wherein said pressure switch is electrically connected in parallel with an audible alarm means and in series circuit relationship with a battery.

3. An air sampling and alarm control system as defined in claim 1 where said air flow damping means comprises a short length of tubing having a predetermined size orifice.

4. An air sampling and alarm control system as defined in claim 3, wherein said flow damper comprises a short length of steel tubing.

5. An air sampling and alarm control system as defined in claim 3, wheein said pressure switch is electrically connected in parallel with an audible alarm means and in series circuit relationship with a battery.

6. An air sampling and alarm control system as defined in claim 3, wherein said alarm is a three terminal alarm device having a control terminal for activating and deactivating said alarm in response to a predetermined reference voltage level.

* * * * *